US006167738B1

(12) United States Patent
Hörold et al.

(10) Patent No.: US 6,167,738 B1
(45) Date of Patent: Jan. 2, 2001

(54) METHOD AND APPARATUS FOR REPLACING THE ROLLERS OF ROLLING MILLS HAVING DIFFERENT SIZES

(75) Inventors: Gunter Hörold; Christian Steglich, both of Dresden (DE)

(73) Assignee: SKET Walzwerkstechnik GmbH, Magdeburg (DE)

( * ) Notice: Under 35 U.S.C. 154(b), the term of this patent shall be extended for 0 days.

(21) Appl. No.: 09/449,600

(22) Filed: Nov. 29, 1999

(30) Foreign Application Priority Data

Dec. 3, 1998 (DE) ..... 198 55 652

(51) Int. Cl.[7] ..... B21B 31/08
(52) U.S. Cl. ..... 72/239
(58) Field of Search ..... 72/237, 238, 239

(56) References Cited

U.S. PATENT DOCUMENTS 3,979,939 * 9/1976 Pazderka ..... 72/239
4,005,594 * 2/1977 Reth et al. ..... 72/239
4,726,108 * 2/1988 Poloni ..... 72/239

FOREIGN PATENT DOCUMENTS 17 77 316 2/1958 (DE) .
60-44118 * 3/1985 (JP) ..... 72/239

* cited by examiner

*Primary Examiner*—Rodney A. Butler
(74) *Attorney, Agent, or Firm*—Collard &Roe, P.C.

(57) ABSTRACT

A method and apparatus for replacing rollers of rolling mills of different sizes involves rollers having lift trunnions mounted on a roller stand in a rolling mill by a roller mounting comprising a plurality of mounting pieces on both ends of the rollers and connected to each other by connecting elements. The roller mounting and the rollers are removed from the roller stand of the roller mill using a conveyor means and passed in a rolling line to an apparatus for replacing the rollers arranged exteriorly of the rolling line. The roller mounting is removed in an upright position and subsequently swung into a horizontal position wherein the mounting pieces are removed from the lift trunnions on both ends of the rollers and brought into a park position. Thereafter, new rollers replace the old rollers in pairs, the mounting pieces are moved back onto the lift trunnions of the new rollers and the completed roller mounting and roller assembly is swung back to the original upright position and returned to the roller stand by the conveyor means. The apparatus includes a swing device for bringing the roller mounting back and forth from the upright position to the horizontal position, a slide device for moving the mounting pieces, and a replaceable multi-functional transport device related in size to the size of the rolling mill.

17 Claims, 5 Drawing Sheets

METHOD AND APPARATUS FOR REPLACING THE ROLLERS OF ROLLING MILLS HAVING DIFFERENT SIZES

BACKGROUND OF THE INVENTION

1. Field of the Invention

The invention relates to a method and an apparatus for replacing the rollers of rolling mills of different sizes and in particular to a method and apparatus where a conveyor means removes the roller mounting of the rolling mill, which essentially comprises mounting pieces connected to one another by means of connecting elements, as well as the rollers journalled rolls in them, from the roller stand of the rolling mill and passes them to an apparatus for replacing the rollers arranged exteriorly of the rolling line.

2. The Prior Art

It is known to replace the rollers of rolling mills using a suitable floor conveyor means, for example a crane, which removes the roller mounting from the roller stand of the rolling mill and deposits them outside of the rolling line in an upright position in a roller exchange apparatus.

Subsequently, for de-mounting of the rollers, the required clamps and connections are released and the rollers are supported in their original position by means of corresponding configured roller support equipment. Thereafter, the mounting pieces, together with pull anchor and associated position drives, are removed on both sides of the rollers from the lift trunnion with the aid of a slide device.

Next, the rollers are, one after the other, replaced with new rollers. This is done using a roller transport dolly, which removes the rollers to be replaced sequentially from the roller support equipment and deposits them on a roller support dolly, and the new rollers are taken from the roller transport dolly and deposited on the roller support equipment. After the new rollers have been placed on the roller support equipment, the assembly of the roller mounting continues in reverse sequence.

It is also known to arrange with respect to the rolling mill lines, roller replacing devices which are adapted to the respective sizes of the rolling mills, with correspondingly high equipment and maintenance effort, as well as space requirements.

Against this background, the following described invention commences.

SUMMARY OF THE INVENTION

The aim of the invention is to provide a method and apparatus for replacing rollers of rolling mills with different sizes with which the mentioned drawbacks of the state of the art are avoided so that with lowered technical installed equipment effort, the replacing of the rollers for rolling mills with different sizes, commencing with the removal of the roller mounting from the rolling mill, continuing with the replacing per se, until the re-assembly of the roller mounting into the rolling mill, takes place in at least the time frame which is required to carry out replacing of rollers with roller replacing equipment which is adapted to the respective rolling mill size. In particular, the space required for replacing the rollers is reduced.

In accordance with the invention this problem is solved through a method for replacing the rollers of rolling mills having different sizes, whereby a conveyor means removes the roller mounting of the rolling mill, which essentially comprises mounting pieces connected to one another by means of connecting elements, as well as the rollers journalled in them, from the roller stand of the rolling mill and passes them to an apparatus for replacing the rollers arranged exteriorly of the rolling line, and whereby by means of the apparatus for replacing the rollers the following process steps are successively carried out:

- the roller mounting is removed in an upright position and is subsequently swung into a horizontal position,
- subsequently, the mounting pieces of the roller mounting on both ends of the rollers in the horizontal position are removed from the lift trunnions of the rollers and brought into a park position,
- thereafter the rollers are replaced in pairs,
- next, the mounting pieces of the roller mounting are returned in the direction of the lift trunnions of the new rollers and moved thereonto, and
- finally, the complete rollers mounting is swung into the original upright position and returned by means of the conveyor means into the roller stand of the rolling mill.

In accordance with an embodiment of the invention, the roller mounting is positioned upright onto a support adapter of a swing device I which forms part of the apparatus for replacing rollers and which can be swung into a horizontal position and back therefrom. The support adapter is sized in accordance with the size of the rolling mill and replaceable.

In a further embodiment of the invention, a slide device II forms a second part of the apparatus for replacing the rollers. Slide device II removes the mounting pieces of the roller mounting at both ends of the rollers in the horizontal position from the lift trunnions of the rollers and moves them to a park position as well as out from the park position and can also move them onto the lift trunnions of the new rollers.

Furthermore, a transport device III forming a third part of the apparatus for replacing the rollers replaces the rollers 1 in pairs. The transport device III is related to the rolling mill size, and is replaceable and multifunctional for an above floor conveyor means. It is also possible in accordance with the invention for the multifunctional transport device III to transport both the complete roller mounting as well as the rollers and the replaceable support adapter. In addition, it is possible to use a separate support adapter of the swing device I and a separate transport device III for each mill size.

The invention also provides an apparatus for replacing the rollers of rolling mills of different sizes, whereby a conveyor means removes the roller mounting of the rolling mill, which essentially comprises mounting pieces connected to one another by means of connecting elements, as well as the rollers journalled in them, from the roller stand of the rolling mill and passes them to an apparatus for replacing the rollers arranged exteriorly of the rolling line. In particular, the apparatus for replacing the rollers comprises a swing device I for the roller mounting from an upright position into a horizontal position and back, a slide device II for the mounting pieces, as well as a multifunctional transport device III which is related to the size of the mill and is replaceable.

In a further embodiment of the apparatus of the invention, the swing device I for the roller mounting is centrally arranged between two shunt carriages arranged symmetrically in mirror-image fashion with respect to one another on a base frame of the slide device II for the mounting pieces and is provided with a replaceable, swingable support adapter related to the size of the mill, for the roller mounting which can be deposited onto the base frame so that the rollers are arranged alongside one another and centrally symmetrically with respect to the axes of symmetry of the shunt carriages.

A further measure contemplates linear drives displacing the shunt carriages in the axial direction of the rollers. The shunt carriages are furnished with respective centering and clamping elements for the respectively associated pair of mounting pieces of the roller mounting.

In addition, swing device I of the roller mounting may comprise a rotation-permitting swing cylinder, centrally arranged beneath the slide device II. The swing cylinder has a piston rod head which, in turn, is rotatably connected to the replaceable support adapter. The support adapter, in turn, comprises two swingably linked support elements arranged parallel with respect to one another, and fixedly connected to one another at the machine/mill/apparatus or hall floor or at the base frame. The support elements are configured, in turn, with contours adapted to the mill size for the support of the lift trunnions of the rollers.

Preferably, the distance of the two support elements of the support adapter is selected such that these elements support the rollers at their lift trunnions in the range between the mounting pieces. It is further contemplated that the support elements per se exhibit the contours of the lift trunnions or are furnished with respectively configured and replaceable contour elements.

It is also advantageous for the piston rod head of the swing cylinder to have a centering alignment for centering it at the base frame as well as load-bearing centering elements for centering thereof at the support adapter.

In a further advantageous embodiment of the invention the transport device III comprises a transport adapter in the shape of a stable traverse related in size to the mill size. The traverse, at least at the face has two gripping cantilevers, which are mirror-images with respect to one another. The cantilevers are fixedly arranged over the circumference of respectively one lift trunnion of a roller gripping cantilever. To each fixedly arranged cantilever is respectively associated a swingable counter cantilever arranged about a vertical axis under the lift trunnion that the rollers come to lay in the counter cantilevers during transport thereof in paired manner. The contours of the fixedly arranged cantilevers and the swingable counter cantilevers are selected so that the rollers during transport are fixed in position between them.

It is also advantageous for the transport adapter embodied by the stable traverse to exhibit abutment elements for the transport by crane per se, abutment elements for the reception of the entire roller mounting, and abutment elements for the replaceable support adapter. By the same token it is advantageous for the apparatus for replacing rollers for each rolling mill size to have a separate support adapter of the swing device I and a separate transport device III.

In accordance with the method and apparatus of the invention, a single apparatus advantageously can replace the rollers of the rolling mills of differing sizes in sequence in proper time and this required time is at most the time which is necessary to realize the replacing by use of replacing devices adapted to the constructive size of the respective rolling mill. Furthermore, by way of the invention the space requirement for the changing of the rollers can be considerably reduced.

Further details, features and advantages of the invention can be had from the following description of an embodiment shown schematically in the drawings, here a stander-less duo-rolling mill, in which the roller mounting comprises mounting pieces with the rollers journalled therein and connecting elements in the form of pull anchors and, in the range of a coupling, separable position drives arranged on the upper mounting pieces for positioning/adjustment of the rollers.

BRIEF DESCRIPTION OF THE DRAWINGS

Other objects and features of the present invention will become apparent from the following detailed description considered in conjunction with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
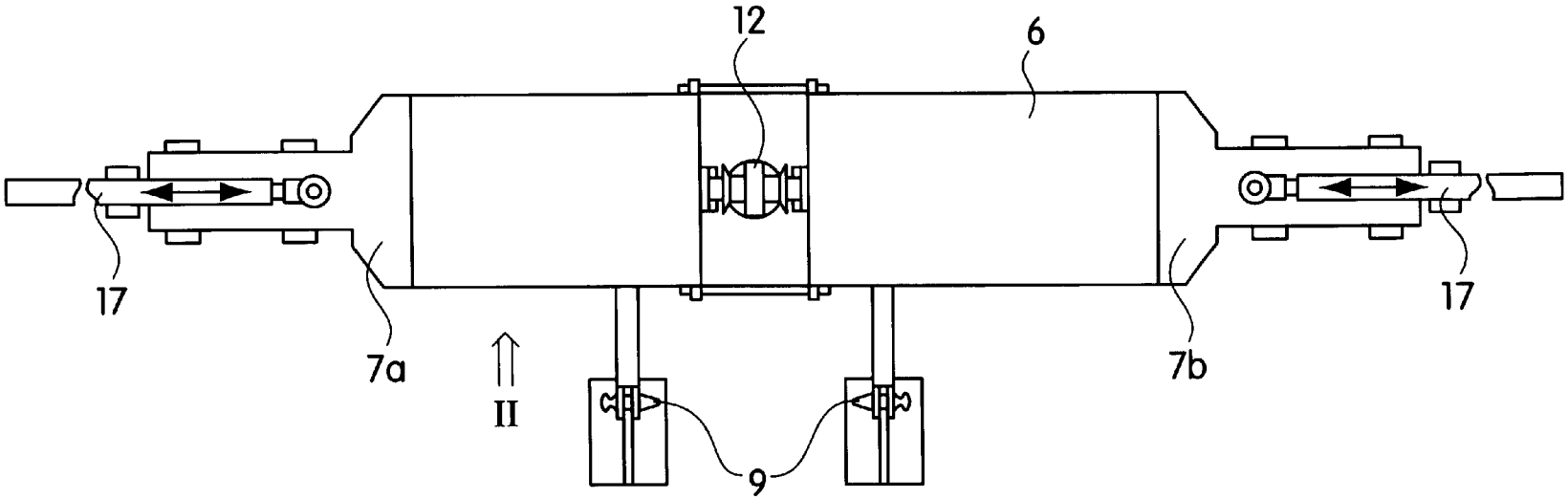
FIG. 1 a plan view of the slide device II of the mounting pieces.
Figure 2:
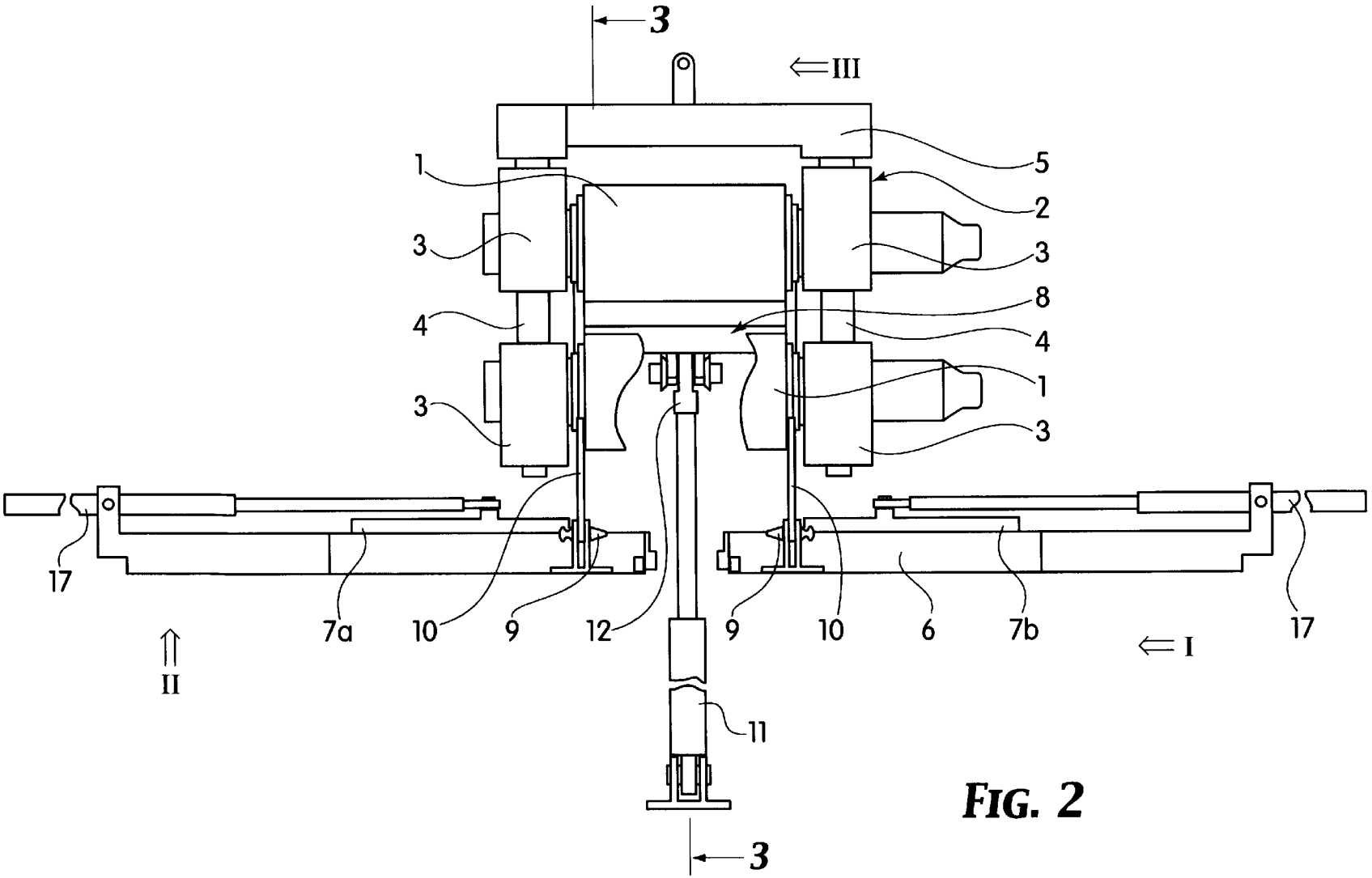
FIG. 2 is a front view according to FIG. 1 inclusive of a swing device I for the roll mounting in the delivery position, as well as a transport device III.
Figure 3:
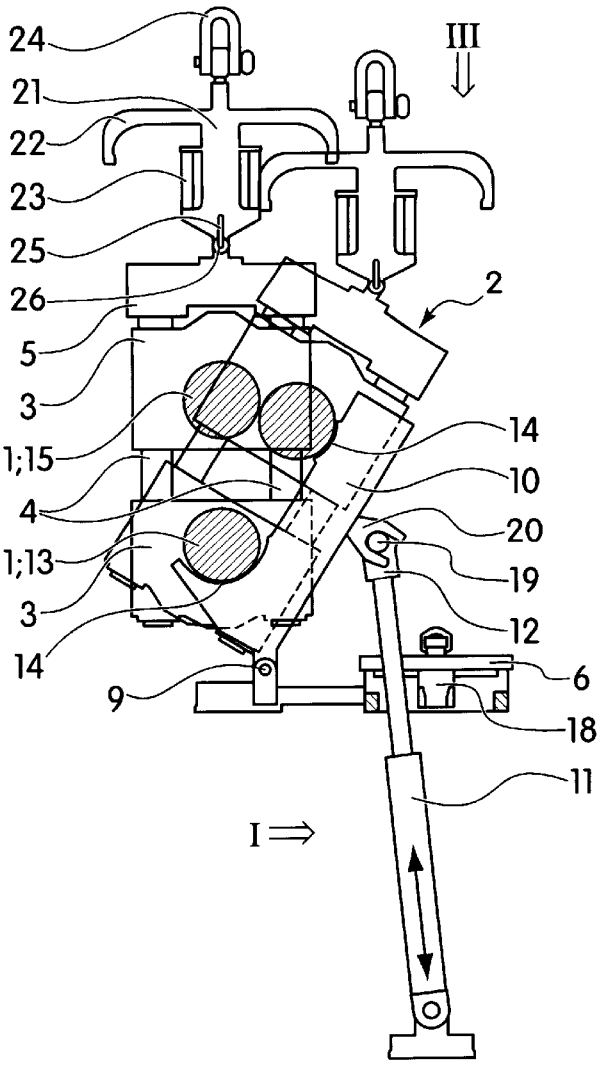
FIG. 3 is a sectional view along line A—A in FIG. 2 in delivery position.

Referring to FIGS. 1 to 3, the apparatus for replacing the roller 1 comprises a swing device I for the roller mounting 2, a slide device II for the mounting pieces 3, together with pull anchor 4 and associated positioning drive 5, in the present example, as well as a multifunctional transport device III.

Swing device I for roller mounting 2 is centrally arranged between two shunt carriages 7*a*, 7*b* which are arranged symmetrically in mirror-image fashion with respect to one another on a base frame 6 of slide device II for the mounting pieces. Swing device I is also provided with a replaceable and swingable support adapter 8 for roller mounting 2 related in size to the size of the rolling mill.

FIG. 2 show roller mounting 2 suspended in an upright delivery position, whereby transport device III, in turn, is suspended from an above-floor conveyor means, for example, a crane, not shown in detail.

Support adapter 8 of swing device I is swung into a nearly fully vertical operational position. It comprises two swingably linked support elements 10, which can be readily mounted and de-mounted by means of pins 9. Support elements 10 are arranged parallel to each other, and are fixedly connected to one another at the machine/mill/apparatus or hall floor or at base frame 6. Swing device I has, furthermore, a swing cylinder 11 centrally arranged beneath slide device II and allowing for rotation. Swing cylinder 11 includes a piston rod head 12 connected to permit rotation to support adapter 8.

Figure 4:
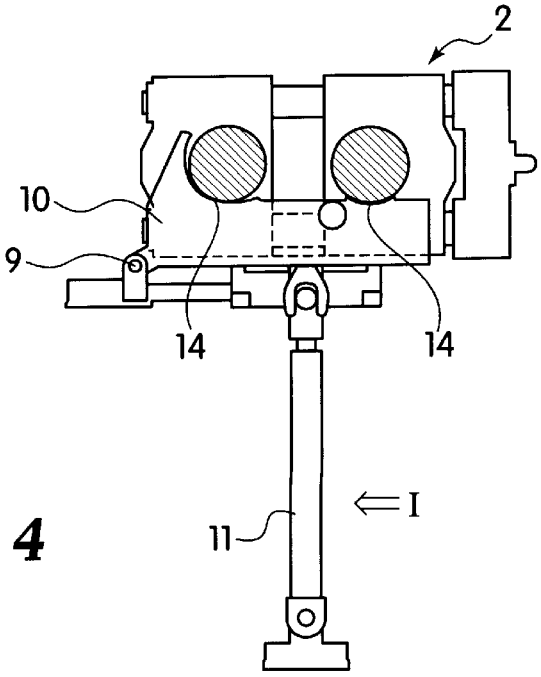
FIG. 4 is a sectional view along line A—A in FIG. 2 in depositing position.

The depositing of the roller mounting 2 for replacing the rollers 1 is done as is shown in FIGS. 3 and 4 in such a way that roller mounting 2 is pendingly supported via transport device III at the crane and with the lift trunnions 13 of the lower rolls 1 is positioned in contours 14 of the support elements 10 of the support adapter 8 adapted to the size of the rolling mill, particularly the diameter of the lift trunnions 13.

For the purposes of safety, it is appropriate to not fully vertically align support adapter 8, but rather to fix it in a position such that lift trunnions 13 of the lower rolls 1 operatively engage in the corresponding contour 14 of support elements 10 and, subsequently, the entire roller mounting 2 is titled by the crane into a position such that lift trunnions 15 of the upper roll also operatively engage in the corresponding upper contour 14 of support elements 10.

The distance of the two support elements 10 of the support adapter 8 is selected so that they support the rollers at their lift trunnions 13 and 15 in the range between the mounting pieces 3.

Figure 6:
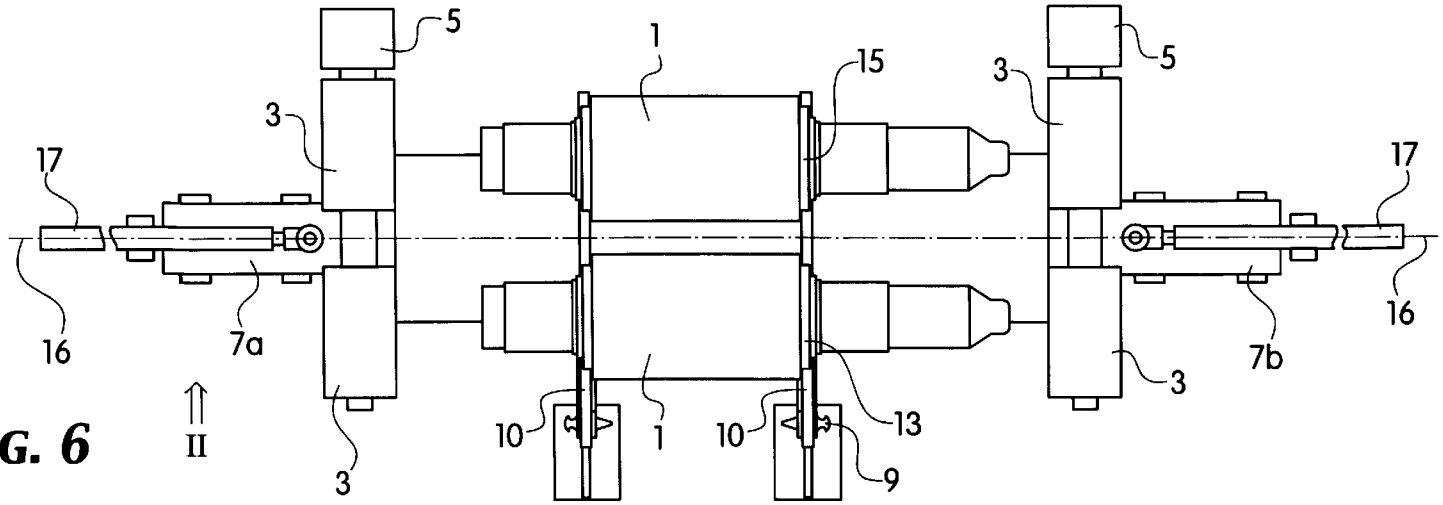
FIG. 6 is a plan view of the embodiment of FIG. 5.
Figure 7:
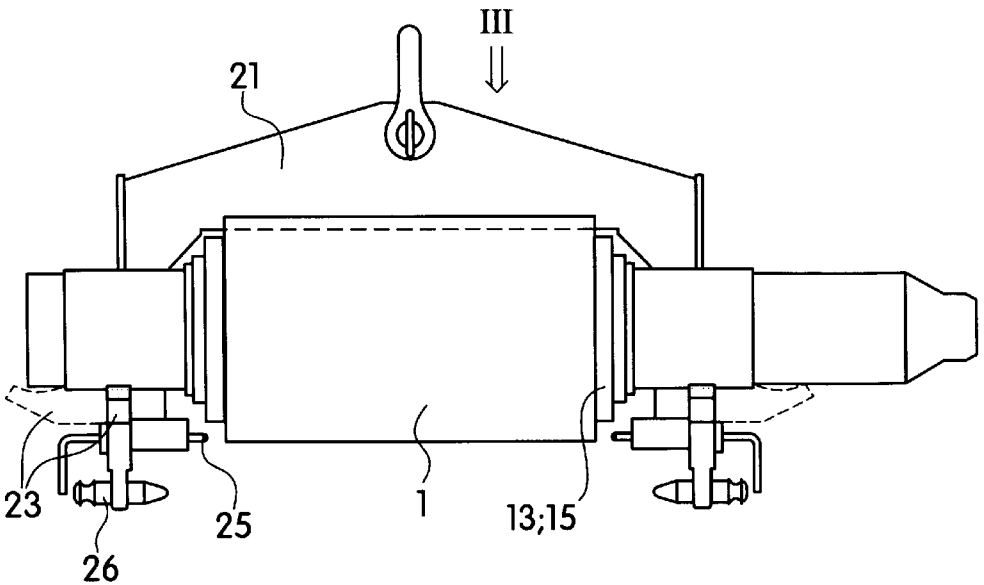
FIG. 7 is a front view of the transport device III.
Figure 8:
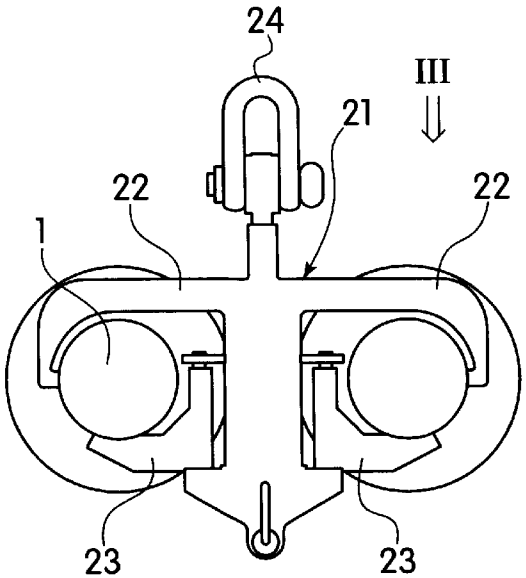
FIG. 8 is a side view of the embodiment of FIG. 7 during take-up of the rolls.

When roller mounting 2 has assumed a stable position on support elements 10, transport device III can be released from roller mounting 2. Subsequently, swing device I swings support adapter 8 into a horizontal position and deposits it on base frame 6 (FIG. 4), so that rollers 1 along one another are arranged centrally symmetrically to the axes of symmetry of the shunt carriages 7*a,* 7*b* (FIG. 6).

Prior to attainment of this operative position for support adapter 8, the two shunt carriages 7*a,* 7*b,* by means of linear drives 17, for example, hydraulic cylinders, on the base frame 6 on guides, not shown in detail but known per se, such as, for example, rails, are moved into a position such that upon depositing of support elements 10 of support adapter 8 mounting pieces 3 arranged at both ends with their side surfaces come to rest upon the corresponding shunt carriage 7*a* and 7*b*. Support elements 10 to a minor extent become separated from lift trunnions 13 and 15 in downward and avoiding manner so as to ensure a support of mounting pieces 3 at all imaginable tolerance/clearances and a clamping of the same at shunt carriage 7*a* or, respectively, 7*b*.

Piston rod head 12 of swing cylinder 11 secures against any lateral shifting (FIG. 3) by way of a centering alignment 18, which assures the same in the retracted piston condition, at the base frame 6. On the other hand, load-absorbing centering elements 19 are associated with piston rod head 12. Fixedly secured fork-like centering elements 20 (FIGS. 3 to 5) engage elements 19 at support adapter 8.

Centering takes place as follows. At the commencement of the lift movement of swing cylinder 11 piston rod head 12 slides out of the centering alignment 18 at base frame 6 and simultaneously the load-absorbing centering elements 19 with the fork-like centering elements 20 come into operative contact at the support adapter 8. This, however, can only be aligned/raised until it assumes a position which is suitable for delivery with roller mounting 2. During retracing of the swing motion of support adapter 8 the centering alignment 18 is returned in base frame 6.

After roller mounting 2, including mounting pieces 3, has been deposited on shunt carriages 7*a,* 7*b,* shunt carriages 7*a,* 7*b* are connected to the respectively associated pair of mounting pieces 3 together with pull anchor 4 and corresponding position drives 5 by means of known centering and clamping elements, (not shown). In this position, the connections between the pairs of mounting pieces 3 can be released as well as the connection of the position drives which are adapted to be parted.

Figure 5:
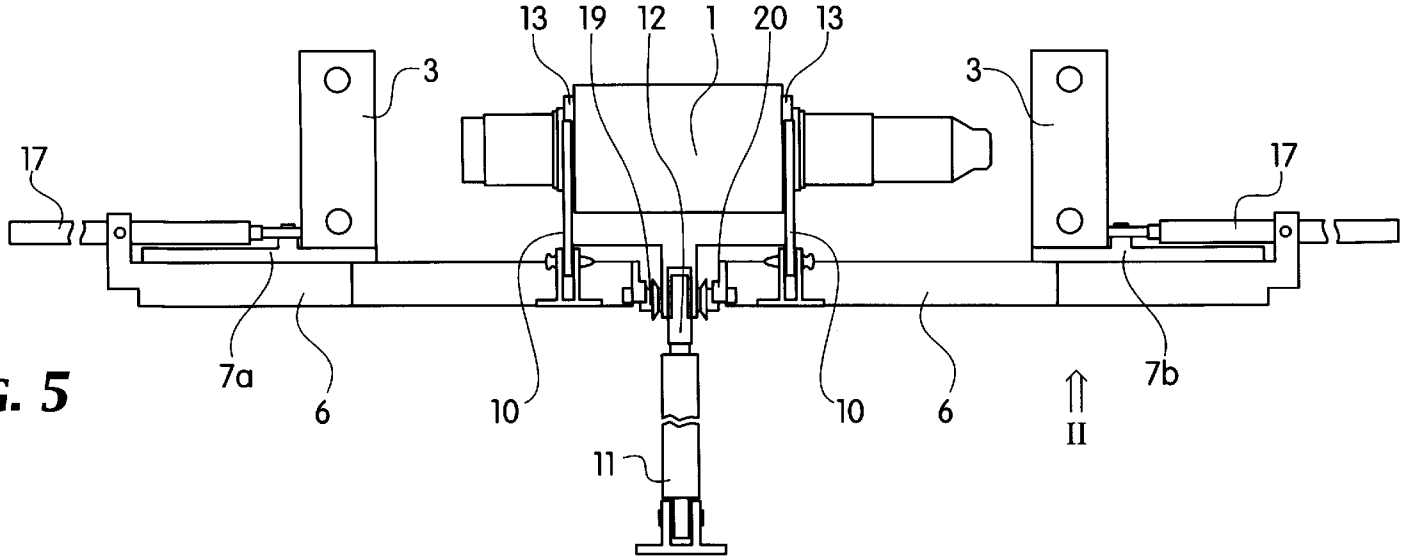
FIG. 5 is a front view of the embodiment of FIG. 4. After shifting of the mounting pieces.

By movement of shunt carriages 7*a,* 7*b* in the axial direction away from the rollers 1, mounting pieces 3 are slid off rollers 1 and moved into a park position. In this way, rollers 1 come to be supported with their lift trunnnions 13, 15 in the contours 14 of support elements 10 (FIGS. 5 and 6). With this arrangement, support elements 10 as such can be configured with the contours 14 or, respectively, these can be formed by suitable working-in. It is also possible to provide the contours 14 by replaceable contour elements, not shown in detail, which can be operatively fixed on support elements 10. At this point in time, the transport device III is employed again.

Transport device III is essentially configured as a transport adapter in the shape of a stable traverse 21 related in size to the size of the mill. Traverse 21, at least at the face, has two gripping cantilevers 22 which are mirror-images with respect to one another and are arranged fixedly over the circumference of respectively one lift trunnion 13 or, respectively 15 of the rollers 1. To each of the fixedly arranged cantilevers 22 a swingable counter cantilever 23 is arranged about a vertical axis under life trunnion 13 or respectively, 15 so that rollers 1 come to lay in counter cantilevers 23 during transport thereof.

The operative arranging of rollers 1 is carried out in accordance with the invention by means of an abutment element 24 pendingly at the crane supported traverse 21. Abutment element 24 is deposited on rollers 1 to be replaced and counter cantilevers 23 are manually swung underneath the corresponding lift trunnion 13 or, respectively 15.

The contour of the fixedly arranged cantilevers 22 and the swingable counter cantilevers 23 is selected so that rollers 1 are fixed in their position during subsequent lifting off from support elements 10 of the transport/support adapter 8. The rollers to be replaced are moved away via a crane.

Subsequently, as described hereinabove, newly to be placed rollers 1 are received by transport device III and deposited in the still horizontally disposed support adapter 8.

The assembly of roller mounting 2 can be done in the reverse sequence of disassembly, whereby the mounting pieces 3 together with pull anchor 4 and corresponding position drives 5 are returned to the direction of lift trunnions 13, 15 of new rollers 1 to be mounted, and are slid upon the same.

When the roller mounting 2 is fully assembled, swing device I swings it from the horizontal position to the upright position where roller mounting 2 is operatively connected to suitable abutment elements 25 of transport device III for roller mounting 2 and positioned into the roller stand of the rolling mill.

When a differently sized rolling mill is to be attended to, that is roller mounting 2 is difference in size, in accordance with the invention support adapter 8 is changed as a function of the size of the rolling mill as is transport device III also as a function of the size of the rolling mill. In this merely the newly, suited transport device III is operatively connected to the crane and then by means thereof by way of further abutment elements 26 the not suited support adapter 8 is replaced by a suitable one. Essentially the replacement of support adapter 8 is realized by release of the pin 9 at base frame 6.

It will be clear without further mentioning that the present invention is not only suited to stand-less rolling mills but also to rolling mills with stands. For rolling mills with stands the connection between the mounting pieces is not by way of pull anchors but rather by other suitable connecting elements, such as, for example, change cassettes or other inter-linking elements.

While a few embodiments of the present invention have been shown and described, it is to be understood that many changes and modification may be made thereunto without departing from the spirit and scope of the invention as defined in the appended claims.

What is claimed is:

1. A method for replacing rollers of rolling mills of different sizes, the rollers having lift trunnions mounted on a roller stand in a rolling mill by a roller mounting comprising a plurality of mounting pieces on both ends of the rollers, said mounting pieces connected to each other by connecting elements, the method comprising:

(a) removing the roller mounting and the rollers from the roller stand of the roller mill using a conveyor means;

(b) passing the roller mounting and the rollers in a rolling line to an apparatus for replacing the rollers arranged exteriorly of the rolling line;

(c) removing the roller mounting in an upright position and subsequently swinging the roller mounting into a horizontal position;

(d) subsequently removing the mounting pieces of the roller mounting from the lift trunnions on both ends of the rollers while the rollers are in the horizontal position and bringing the mounting pieces into a park position;

(e) thereafter replacing the rollers in pairs with new rollers having lift trunnions;

(f) moving the mounting pieces of the roller mounting onto the lift trunnions of the new rollers to form a completed roller mounting and roller assembly;

(g) swinging the completed roller mounting and roller assembly back to the original upright position and returning the assembly to the roller stand of the rolling mill by the conveyor means.

2. A method according to claim 1 further comprising positioning the roller mounting in the upright position onto a replaceable support adapter of a swing device forming part of the apparatus for replacing the rollers, said swing device adapted to be swung into and back from a horizontal position, said support adopter having a size corresponding to the size of the rolling mill.

3. A method according to claim 1, wherein the apparatus for replacing the rollers comprises a slide device, said slide device removing the mounting pieces of the roller mounting from the lift trunnions at both ends of the rollers, moving the mounting pieces into and out of the park position, and moving the mounting pieces onto the lift trunnions of the new rollers.

4. A method according to claim 1 wherein the conveyor means comprises a replaceable, above-floor, multifunctional transport device forming a part of the apparatus for replacing the rollers and related in size to the size of the rolling mill, said transport device replacing the rollers in pairs.

5. A method according to claim 2 wherein the conveyor means comprises a replaceable, above-floor multi functional transport device forming a part of the apparatus for replacing the rollers, said transport device replacing the rollers in pairs, and wherein the completed roller mounting and roller assembly, the rollers, and the replaceable support adapter are transported by the multifunctional transport device.

6. A method according to claim 5 wherein a separate support adapter of the swing device and a separate transport device is used for each rolling mill size.

7. An apparatus for replacing rollers of rolling mills of different sizes, the rollers mounted in a rolling mill by a roller mounting comprising a plurality of mounting pieces on both ends of the rollers, said mounting pieces connected to each other by connecting elements, the roller mounting and the rollers being removed from the rolling mill and passed to the apparatus by a conveyor means, said apparatus comprising:

(a) a swing device for swinging the roller mounting back and forth from an upright position into a horizontal position;

(b) a slide device for moving the mounting pieces; and (c) a replaceable multifunctional transport device related in size to the size of the rolling mill.

8. An apparatus according to claim 7 wherein:

(a) the apparatus further comprises two shunt carriages having axes of symmetry;

(b) the slide device comprises a base frame, said shunt carriages being arranged symmetrically in mirror-image fashion with respect to each other on the base frame;

(c) the swing device is centrally arranged between the shunt carriages and provided with a replaceable, swingable support adapter for the roller mounting, said support adapter being related in size to the size of the rolling mill and adapted to be deposited onto the base frame so that the rollers are centrally arranged alongside one another symmetrically with respect to the axes of symmetry of the shunt carriages.

9. An apparatus according to claim 7 wherein:

(a) the rollers have lift trunnions having circumferences;

(b) the transport device comprises a mill size related transport adapter in the form of a stable traverse, said traverse having a face and at least two mirror-image reaching/gripping cantilevers on the traverse face, said reaching/gripping cantilevers being arranged fixedly over the circumference of one lift trunnion of a roller; and (c) a swingable counter cantilever associated with each fixedly arranged reaching/gripping cantilever about a vertical axis under the lift trunnion, the counter cantilever being arranged so that the rollers lay in the counter cantilevers during transport of the rollers in pairs.

10. An apparatus according to claim 7 further comprising a separate support adapter of the swing device and a separate transport device.

11. An apparatus according to claim 8 wherein each roller has an associated pair of mounting pieces and further comprising:

(a) a plurality of linear drives adapted to displace the shunt carriages in an axial direction of the rollers; and (b) centering and clamping elements for each associated pair of mounting pieces.

12. An apparatus according to claim 8 wherein:

(a) the rollers have lift trunnions;

(b) the swing device comprises a rotation-allowing swing cylinder centrally arranged beneath the slide device, said swing cylinder having a rotation-permitting piston rod head connected to the replaceable support adapter;

(c) the support adapter comprises two parallel swingably linked support elements fixedly connected to each other at a location selected from the group consisting of the rolling mill floor and the base frame, said support elements being configured with contours adapted to the size of the rolling mill for the support of the lift trunnions of the rollers.

13. An apparatus according to claim 12 wherein the two support elements have a distance between them such that the support elements support the rollers at their lift trunnions in the area between the mounting pieces.

14. An apparatus according to claim 12 wherein the support elements themselves exhibit the contours of the lift trunnions or are furnished with respectively configured and replaceable contour elements.

15. An apparatus according to claim 12 wherein the piston rod head of the swing cylinder has:

(a) an associated centering alignment for centering the piston rod head at the base frame; and (b) a plurality of load-bearing centering elements for centering the piston rod head at the support adapter.

16. An apparatus according to claim 9 wherein the fixedly arranged cantilevers and the swingable counter cantilevers have contours such that the rollers are fixed between them during transport.

17. An apparatus according to claim 9 wherein the stable traverse comprises abutment elements to permit transport by a crane along, abutment elements to receive a completed roller mounting and roller assembly, and abutment elements for the replaceable support adapter.

* * * * *